US005437690A

United States Patent [19]

Caldwell et al.

[11] Patent Number: 5,437,690

[45] Date of Patent: Aug. 1, 1995

[54] METHOD FOR DYEING FIBROUS MATERIALS AND DYE ASSISTANT RELATING TO THE SAME

[75] Inventors: Melvin A. Caldwell, Kingsport, Tenn.; John R. Holsten, Spartanburg, S.C.

[73] Assignee: Springs Industries, Inc., Fort Mill, S.C.

[21] Appl. No.: 249,547

[22] Filed: May 25, 1994

[51] Int. Cl.[6] ..... C09B 67/00; D06P 3/04

[52] U.S. Cl. ..... 8/590; 8/925

[58] Field of Search ..... 8/590, 925

[56] References Cited

U.S. PATENT DOCUMENTS

| | | | |
|---|---|---|---|
| 2,895,948 | 7/1959 | Brinker et al. | 260/78.4 |
| 2,997,447 | 8/1961 | Russell et al. | 252/351 |
| 3,232,695 | 2/1966 | Robin et al. | 8/55 |
| 3,363,969 | 1/1968 | Brooks | 8/17 |
| 3,468,864 | 9/1969 | Maxson et al. | 260/93.7 |
| 3,471,248 | 10/1969 | Schaeuble et al. | 8/54 |
| 3,475,771 | 11/1969 | Quynn | 8/173 |
| 3,506,990 | 4/1970 | Richardson et al. | 8/172 |
| 3,558,267 | 1/1971 | Langenfeld | 8/172 |
| 3,591,327 | 7/1971 | Matsuda et al. | 8/166 |
| 3,616,473 | 11/1971 | Leach | 8/172 |
| 3,630,662 | 12/1971 | Brody et al. | 8/172 |
| 3,634,023 | 1/1972 | Foote | 8/130.1 |
| 3,706,524 | 12/1972 | Flensberg et al. | 8/21 A |
| 3,741,719 | 6/1973 | Ramanathan et al. | 8/39 |
| 3,789,091 | 1/1974 | Anderson et al. | 260/927 R |
| 3,918,901 | 11/1975 | Ida et al. | 8/172 |
| 3,929,408 | 12/1975 | Ravet et al. | 8/169 |
| 3,953,168 | 4/1976 | Fabbri et al. | 8/178 R |
| 4,063,880 | 12/1977 | Tullio | 8/41 R |
| 4,066,396 | 1/1978 | Wolf et al. | 8/178 A |
| 4,073,615 | 2/1978 | Lacroix et al. | 8/25 |
| 4,108,936 | 8/1978 | Wolf et al. | 264/78 |
| 4,144,024 | 3/1979 | Lala | 8/25 |
| 4,221,566 | 9/1980 | Lazar et al. | 8/582 |
| 4,397,759 | 8/1983 | Hancock | 252/609 |
| 4,444,563 | 4/1984 | Abel | 8/588 |
| 4,563,190 | 1/1986 | Topfl | 8/524 |
| 4,563,192 | 1/1986 | Salathe et al. | 8/554 |
| 4,705,523 | 11/1987 | Hussamy | 8/490 |
| 4,710,200 | 12/1987 | Cates et al. | 8/574 |
| 4,715,863 | 12/1987 | Navratil et al. | 8/440 |
| 4,752,300 | 6/1988 | Johnson | 8/584 |
| 4,758,649 | 7/1988 | Asano et al. | 528/73 |
| 4,780,105 | 10/1988 | White et al. | 8/574 |
| 4,861,342 | 8/1989 | Danel | 8/444 |
| 4,883,495 | 11/1989 | Jaeckel et al. | 8/115.6 |
| 4,891,398 | 1/1990 | Tanaka et al. | 524/188 |
| 4,898,596 | 2/1990 | Riggins et al. | 8/490 |
| 5,092,904 | 3/1992 | Neely | 8/574 |
| 5,174,790 | 12/1992 | Riggins et al. | 8/490 |
| 5,207,803 | 5/1993 | Holsten et al. | 8/586 |
| 5,275,627 | 1/1994 | Cates et al. | 8/572 |

FOREIGN PATENT DOCUMENTS

| | | |
|---|---|---|
| 2180131 | 11/1973 | France . |
| 02175980 | 7/1990 | Japan . |
| 6800400 | 7/1969 | South Africa . |
| 1275459 | 5/1972 | United Kingdom . |
| 1282113 | 7/1972 | United Kingdom . |

OTHER PUBLICATIONS

Cook et al., *Evaluation of the STX® System for Solvent Dyeing of Industrial Fabrics Part II: Kevlar® Aramid and PBI® Fabrics, Journal of Industrial Fabrics,* pp. 11–28 (Summer 1983).

Clemens et al., *Aramid Fibers, Aguaculture Digest,* 3:213–242 (1978) no month available.

Schuler, *Dyeing with Disperse Dyes,* 12:33–35 (Aug. 1980).

*Primary Examiner*—Paul Lieberman

*Assistant Examiner*—Margaret Einsmann

*Attorney, Agent, or Firm*—Bell, Seltzer, Park & Gibson

[57] ABSTRACT

A method for dyeing fibrous material is provided. The method includes contacting a fibrous material with a dyebath comprising a mixture of a dye assistant and a dye soluble or dispersed with the dye assistant in the dyebath. The dye assistant comprises a N-alkyl substituted aromatic sulfonamide. The dye assistant of the present invention can be advantageously utilized for dyeing difficult to dye fibers such as aromatic polyamide fibers, polybenzimidazole fibers and aromatic polyimide fibers.

18 Claims, No Drawings

METHOD FOR DYEING FIBROUS MATERIALS AND DYE ASSISTANT RELATING TO THE SAME

The present invention relates to a method for dyeing fibrous material, and particularly fibrous materials having flame resistant properties and which are difficult to dye such as aromatic polyamides, polybenzimidazoles or aromatic polyimides.

BACKGROUND OF THE INVENTION

There are various recognized methods for dyeing and/or incorporating additives into fibers and other fibrous materials and particularly difficult to dye fibers such as aromatic polyamides, polybenzimidazoles and polyimides. These methods sometime utilize organic solvents such as dimethylsulfoxide ("DMSO"), dimethylacetamide ("DMAC"), dimethylformamide ("DMF"), N-methylpyrrolidone ("NMP"), N-cyclohexyl-2-pyrrolidone ("CHP"), acetophenone, benzyl alcohol, acetanilide and methyl benzoate. Exemplary systems utilizing these organic solvents have been proposed in U.S. Pat. Nos. 3,558,267 to Langenfeld, 3,741,719 to Ramanathan et al, 4,525,168 to Kelly, 4,898,596 to Riggins et al and U.K. Pat. Nos. 1,275,459 to Gruen and 1,282,113 to Burtonshaw et al. the disclosures of which are incorporated herein in their entirety. Other methods are described, for example, in U.S. Pat. Nos. 4,780,105 to White et al., 5,092,924 to Neely et al. and 5,207,803 to Holsten et al. the disclosures of which are incorporated by reference herein in their entirety.

The organic solvents are sometimes referred to as "swelling agents" in that solvents swell the fiber at elevated temperatures to permit the dye molecules to be introduced into the fiber. It is believed that when the swollen fiber is cooled or the solvent is removed (e.g., by heating), the fiber returns to its original condition and the dye molecules are entrapped in the fiber. Certain of the organic solvent swelling agents, however, tend to damage the fibers by the swelling action. For example, organic solvents can adversely affect tear strength properties. There also has been some environmental concern with respect to certain of the organic solvents.

Retention of solvent can adversely affect both the appearance and the flame resistance of the fibers. Prior art techniques for-dyeing difficult to dye fibers such as aromatic polyamides (i.e., poly-m-phenyleneisophthalamide) ("Nomex®") and poly(p-phenyleneterephthalamide) ("Kevlar®"), polybenzimidazoles, aromatic polyimides, and the like can be counter-productive in that one of the problems caused by retention of solvent (e.g., decreased flame resistance) requires addition of a significantly large portion of a flame retardant to compensate for the reduction in the flame resistant properties of the fibers.

It is therefore an object of the present invention to provide an improved method and dye assistant for dyeing fibrous materials, and particularly to provide a method and dye assistant which obviates the need to utilize organic solvents and carriers that tend to damage the fibers by their swelling action.

It is another object of the present invention to provide a method and dye assistant having one or more particularly advantageous results, including increased efficiency in dye exhaustion, maintenance of tear strength, and more level and uniform dyeing as compared to the absence of a carrier or organic solvent.

The improved method and dye assistant is particularly advantageous when used with difficult to dye fibers such as aromatic polyamide fibers (e.g., Nomex® and Kevlar® fibers), polybenzimidazole fibers, aromatic polyimide fibers, fibers of copolymers of the monomers thereof and blends thereof.

SUMMARY OF THE INVENTION

This invention relates to a method for dyeing fibrous material which includes the steps of contacting the fibrous material (e.g., aromatic polyamide fibers) with a mixture (e.g., a solution or dispersion) containing a dye assistant and a dye (e.g., a dyebath) followed by fixing the dye in the fibrous material. The dye assistant of the present invention comprises an N-alkyl substituted aromatic sulfonamide. The substitution can be at either the alpha or beta positions. The aromatic portion may also be substituted at the para, ortho, or meta positions. Exemplary N-alkyl substituted aromatic sulfonamides include N-(n-butyl)benzenesulfonamide ("BBSF"), N-(iso-butyl)benzenesulfonamide, N-(n-propyl)-benzenesulfonamide, N-(iso-propyl)benzenesulfonamide, N-(n-butyl)-p-toluenesulfonamide, N-(iso-butyl)-p-toluenesulfonamide, N-(n-propyl)-p-toluenesulfonamide, N-(iso-propyl)-p-toluenesulfonamide, N-(ethyl)-p-toluenesulfonamide ("ETSM"), N-(n-butyl)xylenesulfonamide, N-(iso-butyl)xylenesulfonamide, N-(n-propyl)xylenesulfonamide, N-(iso-propyl)-xylenesulfonamide, N-(ethyl)xylenesulfonamide, N-(methyl)xytenesulfonamide, N-(n-butyl)cumene-sulfonamide, N-(iso-butyl)cumenesulfonamide, N-(n-propyl)cumenesulfonamide, N-(iso-propyl)cumenesulfonamide, N-(ethyl)cumenesulfonamide, N-(methyl)cumenesulfonamide, N-(ethyl)napthalenesulfonamide, and N-(methyl)-napthalenesulfonamide. Such a dye assistant is nonwater soluble and is a weak organic acid solvent. The dye assistant of the present invention promotes diffusion of the dye into the fibrous material.

The use of the present dye assistant results in improved dyeing characteristics. For example, more uniform and level dyeing is achieved as compared to comparable levels of the organic solvents and carriers of the prior art, particularly when used to dye fibers such as aromatic polyamide fibers, polybenzimidazole fibers, aromatic polyimide fibers, fibers of copolymers of the monomers thereof and blends thereof.

DETAILED DESCRIPTION OF THE INVENTION

As summarized above, the present invention provides an improved dyeing system which obviates the need for using the organic solvents of the prior art, and more particularly reduces or substantially eliminates the need for using such organic solvents to swell the fibers. The dye assistant preferably comprises as its major constituent an N-alkyl substituted aromatic sulfonamide. In an embodiment, the dye assistant can optionally be emulsified or dispersed. For example, the dye assistant can be emulsified in the reaction product of an alkylene oxide (e.g., ethylene oxide or propylene oxide) and a long straight chain alkane alcohol to provide an alkoxylated (e.g., ethoxylated) alcohol.

The method of the present invention can advantageously be employed using customary dyeing techniques. The dye and the dye assistant, and any other additives are typically utilized by forming a mixture (e.g., a bath, solution, dispersion or the like) of the dye and the dye assistant, followed by contacting the fiber and/or fabric with this mixture and then preferably fixing the dye in the fiber. In accordance with the present invention, a fibrous textile material, e.g., fiber, web, yarn, thread, sliver, woven fabric, knitted fabric, non-woven fabric, and the like is impregnated, padded, or otherwise contacted with the bath and the dyestuffs and/or additives fixed in the substrate using conventional equipment such as jet dyeing or other appropriate equipment. Residual amounts of the dye assistant can be removed from the dyed fibers by heating or appropriate scouring and rinsing, or can be retained in the fibers with the proviso that the retained dye assistant does not adversely affect appearance and flame resistance of the dyed fibers.

Exemplary N-alkyl substituted aromatic sulfonamides are N-(n-butyl)benzenesulfonamide ("BBSF"), N-(iso-butyl)benzenesulfonamide, N-(n-propyl)benzenesulfonamide, N-(iso-propyl)benzenesulfonamide, N-(n-butyl)-p-toluenesulfonamide, N-(iso-butyl)-p-toluenesulfonamide, N-(n-propyl)-p-toluenesulfonamide, N-(iso-propyl)-p-toluenesulfonamide, N-(ethyl)-p-toluenesulfonamide ("ETSM"), N-(n-butyl)xylenesulfonamide, N-(iso-butyl)xylenesulfonamide, N-(n-propyl)xylenesulfonamide, N-(iso-propyl)xylenesulfonamide, N-(ethyl)xylenesulfonamide, N-(methyl)-xylenesulfonamide, N-(n-butyl)cumenesulfonamide, N-(iso-butyl)cumenesulfonamide, N-(n-propyl)-cumenesulfonamide, N-(iso-propyl)cumenesulfonamide, N-(ethyl)cumenesulfonamide, N-(methyl)-cumenesulfonamide, N-(ethyl)napthalenesulfonamide, and N-(methyl)-napthalenesulfonamide. The N-alkyl substituted aromatic sulfonamides are nonwater soluble and weak organic acids. These compounds function as dye assistants or "carriers" for introducing dyestuffs and/or other additives, typically soluble in the N-alkyl substituted aromatic sulfonamides, into the fibrous material. The N-alkyl substituted aromatic sulfonamides promote diffusion of the dye into the fiber and can be removed by heating the dyed fibrous material.

The N-alkyl substituted aromatic sulfonamides are characterized by the residual hydrogen on the nitrogen atom thereof being weakly acidic due to the strong electronegativity of the adjacent sulfonyl function. This permits the N-alkyl substituted aromatic sulfonamides to be soluble in strong bases such as sodium hydroxide solution at room temperature or slightly above room temperature. It is believed that the weak acid character of N-alkyl substituted aromatic sulfonamides result in their reduced retention in the fibrous material inasmuch as the N-alkyl substituted aromatic sulfonamides are not strongly held by the fibers. The weak acid character also contributes to their function as a built-in leveling agent in that emulsifiers are not required, and merely are optional. This is contrasted to the basic or neutral organic solvents of the prior art such as CHP, NMP, DMAc and the like, which swell the fibrous material and are often strongly absorbed by the fibrous material due to their basic characteristic. Moreover, many organic solvents often require large amounts of dispersants and emulsifiers.

The N-alkyl substituted aromatic sulfonamides can be dispersed merely by using high shear mixing techniques such that the use of emulsifiers or dispersants can be avoided if desired. Optionally, the sulfonamide can be predissolved in an alkali such as sodium hydroxide.

It is recognized that it may be necessary to use an emulsifier, particularly if the dye assistant, because of the addition of various additives, is difficult to disperse. Particularly preferred emulsifiers are the UNITHOX® and PETROLITE® emulsifiers (e.g., UNITHOX® 480, UNITHOX® 550 and PETROLITE X-8014® available from Petrolire, Tulsa, Okla. The UNITHOX® emulsifiers are the reaction product of an alkylene oxide (e.g., ethylene oxide) and a long, straight chain primary alkyl alcohol having $C_{30}$ to $C_{50}$ average chain length. For example, UNITHOX® 480 is the product obtained by reacting a $C_{30}$ straight chain alcohol with sufficient ethylene oxide to provide a product containing 80 percent by weight ethylene oxide adduct. UNITHOX® 550 contains an ethoxylated $C_{40}$ alcohol, 50 percent by weight of which is ethylene oxide adduct. PETROLITE X-8014® is an ethoxylated nonylphenol. A possible dispersant is Apex 1600 sold by Apex Chemical Corporation of Elizabeth, N.J.

The total weight of the N-alkyl substituted aromatic sulfonamides in the dyebath may be suitably in the range from about 1 to 10 percent based on the weight of the dyebath. Typically, about 0.1 to 0.3 percent based on the weight of the dyebath of an emulsifier or dispersant can be present.

In view of the desirable results achieved to date, it is thought that the use of the dye assistant of the present invention is applicable with a wide variety of additives such as flame retardants (e.g., Pyron 642, a brominated chlorinated phosphonate flame retardant available from Chemonic Industries, Inc., of Greensboro, N.C.), softeners, UV absorbers, IR absorbers, antistatic agents, antifoaming agents, bactericides, anticracking agents, fungicides, anti-viral agents or the like, and to a wide variety of fibrous material and includes fibers and fibers which have been formed into fabrics including woven, non-woven or knit fabrics, for example.

The dye assistant can be used advantageously to dye a variety of flame resistant fibers which are difficult to dye, namely, aromatic polyamides, polybenzimididazoles, and aromatic polyimides, copolymers of the monomers thereof, and blends thereof. The carrier is particularly desirable in dyeing fabrics wherein differences in individual yarns tend to result in streaking.

As noted above, the carrier is also particularly desirable for use with aromatic polyamides. Fibers of aromatic polyamides have flame resistant properties and are often generically termed "aramid fibers" and are described, for example, in Kirk-Othmer: *The Encyclopedia of Chemical Technology*, Third Edition, Vol. 3, pp. 213–242. The term "aromatic polyamides" or "aramids" includes but is not limited to poly(m-phenyleneisophthalamide) (e.g., Nomex®), poly(p-phenyleneterephthalamide) (e.g., Kevlar®), polyparabenzamide, copolymers of the monomers thereof, and blends therewith. Nomex® is available from DuPont of Wilmington, Del., in three forms. Nomex® T-450 is a 100 percent, undyed poly(m-phenyleneisophthalamide); Nomex® T-456 is 100 percent solution dyed poly(m-phenyleneisophthalamide); and Nomex® T-455 is a blend of 94 percent Nomex® (poly(m-phenyleneisophthalamide)) and 6 percent Kevlar® (poly(p-phenyleneterephthalamide)). It is noted that DuPont has recently changed its formulation of Nomex® T-455 to this formulation. The old formulation had 95 percent Nomex® and 5 percent Kevlar®. Nomex® is also available as Nomex® IIIA, which includes 2 to 3 percent by weight carbon fibers encapsulated in an aliphatic polyamide (i.e., nylon 6,6) sheath. The present invention is particularly advantageous in dyeing Nomex® IIIA in that the N-alkyl substituted sulfonamides acts as an effective dye assistant, particularly with cationic dyes for both the Nomex® portion and the nylon portion in many shades. Thus a single dyebath can be used as compared to the need when using conventional carriers or organic solvents, to use a two-stage dyebath with one dye used to dye the Nomex® portion and a different dye to dye the nylon 6,6 portion.

Another group of fibers which have flame resistant properties and are difficult to dye are the polybenzimidazole fibers available from Höechst-Celanese of Charlotte, N.C. and are described in U.S. Pat. No. 2,895,948 to Brinker et al, the disclosure of which is incorporated herein by reference. Polybenzimidazoles use specific dicarboxylic and tetramine compounds as monomers and have the repeating unit of the formula:

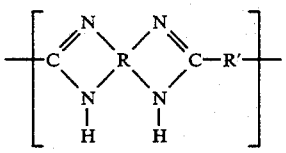

where R and R′ are aromatic moieties.

Another group of fibers having flame resistant properties and are difficult to dye are aromatic polyimide fibers described in U.S. Pat. No. 4,758,649 to Asano et al, the disclosure of which is incorporated herein by reference. The aromatic polyimides have the repeating unit of the formula:

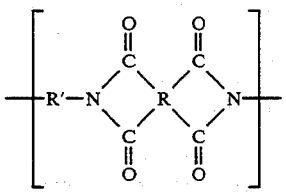

where R and R′ are aromatic moieties.

In addition, copolymers of monomers or blends of the aromatic polyamides, polybenzimidazoles and/or aromatic polyimides can advantageously be dyed using the present carrier. For example, aromatic polyamide fibers and polybenzimidazole fibers can be blended in a weight ratio of about 60:40 to about 80:20 aromatic polyamide fibers to polybenzimidazole fibers. The blends can be in the form of intimate blends, draw blends, corespun and the like.

Dyes which can be used advantageously with the present carrier can include basic dyes (e.g., triphenylmethane, thiazide dyes, etc.); direct dyes (e.g., sulphonated azo dyes, etc.); mordant dyes; vat dyes; disperse dyes (e.g., nitroarylamine, azo, or anthraquinone dyes, and the like with amino groups); reactive dyes; and mixtures thereof with the proviso that the dyes do not decompose under customary dyeing conditions. Particularly effective dyes for dyeing aromatic polyamide fibers, polybenzimidazole fibers and aromatic polyimide fibers are the basic dyes (sometimes referred to as "cationic dyes"). Examples of this class are the Basacryl® dyes available from BASF, Charlotte, N.C. and the Maxillon® dyes available from Ciba-Geigy Corporation, Greensboro, N.C.

In operation, the dye and/or other additive is preferably applied to the fibers of a fabric using a batch-type process at 100° F. to 300° F. at 1 to 4 atm pressure. The fabric can be prescoured by passing the fabric through a hot aqueous scour which includes 0.5 percent owf soda ash and 1.0 percent owf Apex 1600 in a jet dye machine or other scouring equipment. The jet is then charged with water and other auxiliaries including the dye and the dye assistant. The pH of the dyebath is maintained at from about 2.5 to 4.5, and preferably from about 3 to 4. The temperature and pressure are then increased to a temperature above about 250° F. and preferably above about 270° F. and a pressure above about 2.5 atm and held for about 15 minutes to about 1.5 hours to complete the exhaustion of the dye. The fabric is allowed to cool, the dyebath dropped, the fabric rinsed and then after-scoured, if required. The resulting fabric has greater than about 75 percent of the charged dyestuff, preferably about 95 percent exhausted into the fabric. The dye and any additives are fixed into the fiber during the dye cycle.

Additional benefits and advantages of the invention will be apparent from the following illustrative examples.

EXAMPLES

Examples 1 and 2 demonstrate that the dye assistant of the present invention can be used without the need for an emulsifier or dispersant.

Example 1

A dye assistant is prepared by placing 9480 g of water in a tank equipped with a three blade mixer. N-(n-Butyl)benzenesulfonamide (hereinafter referred to as "BBSF"), available as Plasthall® BSA from C. P. Hall Company of Chicago, Ill., 4,740 g, is added followed by slowly adding 2,450 g of 50 percent sodium hydroxide solution. The mixture is stirred for 10 minutes until clear and no free oil is present.

A 20,884 g sample of Nomex® IIIA is placed in a partially charged dyebath vessel at 90° F., and 3 percent owf of Sedgelube SLK (anticracking agent) available from Sedgefield Specialties, Greensboro, N.C., 0.5 percent owf of Vanquest DT (18 percent by weight solution of ethylenediamine tetraacetic acid, sodium salt with 0.3 to 0.5 percent trisodium nitrilotriacetate) available from Vantex, Inc., Oakboro, N.C., and 0.15 percent owf of sodium thiosulfate are added at 90° F. over a 10 minute period. The pH is adjusted to about 2.5 with 7351 g of acetic acid (56 percent). The dissolved BBSF dye assistant is added very slowly over a 20 minute period at 90° F. The soluble BBSF sodium salt is neutralized by the acidic dyebath and the BBSF precipitates in a finely dispersed state which is rapidly sorbed onto the fabric. A solution providing 10 g/l of sodium nitrate based upon full dyebath volume is added over 10 minutes and the dyebath run for 10 minutes at 90° F. The pH is checked and is 4.1 (the bath is clear and presumably the BBSF is exhausted). 1 Percent owf of Basacryl Golden Yellow X-GFL is added over a 10 minute period. The dye bath is run for 10 minutes, the pH checked and is 4.05. The temperature is increased at 3° F. per minute to 190° F., then increased at 1° F. per minute to 220° .F, then increased at 3° F. per minute to 265° F. and is run for one hour. The temperature is cooled to 200° F. at 3° F. per minute, then cooled to 190° F. at 1° F. per minute, then cooled to 90° F. at 3° F. per minute. The bath is drained and refilled, and the fabric is rinsed until the water is clear. The fabric is extracted and dried on a tenter at 250° F. The fabric had a level dyeing.

Example 2

A dye assistant is prepared by placing 1500 g of water in a tank equipped with a three blade mixer. A 272 g sample of BBSF is added. The mixture is stirred for 10 minutes until a uniform dispersion is obtained and stirring is maintained.

An 1816 g sample of Nomex® IIIA is placed in the partially charged dyebath vessel at 90° F., and 3 percent owf of Sedgelube SLK, 0.5 percent owf of Vanquest DT, 0.15 percent owf of sodium thiosulfate, and 1 percent owf acetic acid (56%) are added at 90° F. over a 10 minute period. The dyebath is heated to 120° F. at 3.0° F. per minute. The BBSF dye assistant dispersion is added very slowly over a 20 minute period at 120° F. A solution providing 20 g/l sodium nitrate based upon full dyebath volume is added over 10 minutes and the dyebath run for 10 minutes at 120° F. 2.6 Percent owf Maxilon Blue GRL 300 percent pearls, 1.41 percent owf Basacryl Red GL and 0.6 percent owf of Basacryl Golden Yellow X-GFL that are dissolved in acidic boiling water are added over a 10 minute period at 120° F. The temperature is increased at 3° F. per minute to 190° F., then increased at 1° F. per minute to 220° F., then increased at 3° F. per minute to 265° F. and is run for one hour. The temperature is cooled to 220° F. at 3° F. per minute, then cooled to 190° F. at 1° F. per minute, then cooled to 130° F. at 3° F. per minute. The bath is drained, refilled with water, and the fabric rinsed until the water is clear. The fabric is extracted and dried on a tenter at 350° F. The fabric had a level dyeing.

Example 3

A dye assistant is prepared by melting 80 g UNITHOX® 480 in 400 g BBSF at 220° F. while stirring with a three blade mixer. Water (1520 g) is heated to 205° F. to 212° F. The UNITHOX®/BBSF mixture is then slowly added with stirring into the water while maintaining a temperature above 180° F. Stirring is continued ten minutes longer than the time required to add the UNITHOX®/BBSF mixture to the water. The mixture is then cooled to 100° F. while continually stirring. This yields a mix that is 20 percent by weight BBSF.

A 1680 g sample of Nomex® IIIA is placed in the partially charged dyebath vessel at 120° F., and 3 percent owf of Sedgelube SLK, 0.15 percent owf of Vanquest DT, and formic acid to a pH of 2.5 to 3.0 are added at 120° F. over a 10 minute period. Emulsified BBSF dye assistant (1890 g) is added very slowly over a 20 minute period at 120° F. A solution providing 20 g/l of sodium nitrate based upon full dyebath volume is added over 10 minutes and the dyebath run for 10 minutes at 120° F. 2.6 Percent owf Maxilon Blue GRL 300 percent pearls, 1.41 percent owf Basacryl Red GL and 0.60 percent owf of Basacryl Golden Yellow X-GFL are dissolved in boiling acidic water and added over a 10 minute period to the bath at 120° F. The pH is adjusted to 3 to 3.5 with acetic acid. The temperature is increased at 3° F. per minute to 190° F., then increased at 1° F. per minute to 220° F., then increased at 3° F. per minute to 265° F. and is run for one hour at 265° F. The temperature is cooled to 190° F. at 1° F. per minute, then cooled to 100° F. at 3° F. per minute. The bath is drained and refilled, and the fabric is rinsed until the water is clear. The fabric is extracted and dried on a tenter at 350° F. The fabric had a level dyeing.

Example 4

In order to demonstrate level dyeings at different concentrations of the dye assistant and establish the effect of BBSF concentration on color yield, various lab scale dyeings are conducted. A 10 g sample of Nomex III fabric is dyed with 0.3 g of Maxillon Blue GRL Pearls, 300 percent, 0.3 g of Sedgelube SLK, 0.015 g of Vanquest DT, and 3.0 g sodium nitrate. The dyestuff is dissolved in boiling acidic solution, added to the dyebath and the pH is adjusted to 3 to 3.5 with acetic acid. The dye cycle described in Example 3 is followed by a running rinse at 130° F. The dyeings are completed in an Ahiba Polymat machine available from Ahiba-Datacolor, Charlotte, N.C. The different concentrations of BBSF dye assistant used and the results are summarized in Table I.

TABLE I

| Run No. | G/L | L* |
|---|---|---|
| 1 | 10 | 26.72 |
| 2 | 20 | 24.67 |
| 3 | 30 | 23.61 |
| 4 | 40 | 23.37 |
| 5 | 50 | 23.01 |
| 6 | 60 | 22.51 |
| 7 | 70 | 23.79 |
| 8 | 80 | 23.31 |
| 9 | 90 | 22.75 |
| 10 | 100 | 23.51 |
| 11 | 110 | 23.21 |
| 12 | 120 | 23.12 |

Example 5

Example 4 is repeated except that a different dye is used. The dye comprises 2 percent owf Basacryl Yellow X-GFL. Table II summarizes the results.

TABLE II

| Run No. | G/L | L* |
|---|---|---|
| 1 | 10 | 68.04 |
| 2 | 20 | 64.74 |
| 3 | 30 | 62.77 |
| 4 | 40 | 62.05 |
| 5 | 50 | 62.02 |
| 6 | 60 | 61.83 |
| 7 | 70 | 62.08 |
| 8 | 80 | 61.7 |
| 9 | 90 | 61.89 |
| 10 | 100 | 61.82 |
| 11 | 110 | 61.91 |
| 12 | 120 | 62.15 |

Example 6

Example 6 demonstrates the effectiveness of the dye assistant including a flame retardant. The dye assistant is prepared by placing 1880 g of water and 2.65 g Pyron 642 flame retardant in a tank equipped with a three blade mixer. BBSF (470 g) is added. The mixture is stirred for 10 minutes to afford a uniform dispersion. A 2088 g sample of Nomex® IIIA is placed in the partially charged dyebath vessel at 120° F. 3 Percent owl of Sedgelube SLK, 0.5 percent owf of Vanquest DT, 0.10 percent owf of sodium thiosulfate, and 2 percent owf acetic acid (56%) are added at 120° F. The dye assistant dispersion is added over a 15 minute period at 120° F. while keeping the bath stirred. A solution providing 5 g/l of sodium nitrate based upon full dyebath volume is added over 10 minutes and the dyebath run for 10 minutes at 120° F. 1.5 Percent owf Maxilon Blue GRL 300 percent pearls and 0.135 percent owf Basacryl Red GL were dissolved in boiling acidic water and added over a 10 minute period to the bath at 120° F, and the bath circulated for 10 minutes at 120° F. The bath is maintained at a pH of 2.5 to 3.0 with acetic acid. The temperature is increased at 3° F. per minute to 190° F., then increased at 1° F. per minute to 220° F., then increased at 3° F. per minute to 265° F. and is run for one hour at 265° F. The temperature is cooled to 160° F. at 2.5° F. per minute and cold water is then added to cool to 130° F. and run 5 minutes. The bath is drained and refilled, and the fabric is heated to 140° F. and run 5 minutes at 140° F. Water is added to cool to 120° F. and the bath drained. The bath is refilled and heated to 100° F. and run 5 minutes and drained. The bath is then refilled and heated to 100° F. and run 5 more minutes and drained. The fabric is dried on a tenter at 250° F. The fabric had a level dyeing.

Example 7

Example 7 demonstrates the flame retardancy properties of fabrics dyed with the BBSF dye assistant using different dyes. The dye assistant comprises 20 g/l of a 60 percent solid emulsion of 80 parts BBSF and 20 parts UNITHOX® 480, and is mixed. A 10 g sample of Nomex® III fabric is dyed with the various dye compositions listed in Table III, and the dyebath including 3 percent owf Sedgelube SLK, 0.5 percent owf Vanquest DT, 0.15 percent owl sodium thiosulfate, 5 percent owf Pyron 642 flame retardant, 25 g/l of the BBSF/Unithox® 480 mixture, and 20 g/l sodium nitrate. The pH is adjusted to 3 to 3.5 with acetic acid. The dyed fabric is tested for vertical flame resistance using Federal Test Method 191-5903.

Test Method 191-5903 is a measurement of the resistance of fabric to flame and glow propagation and tendency to char. A test specimen comprising a 2¾ by 12 inch (70 mm by 305 mm) test specimen is exposed to a Tirrill burner flame 3 inches (76 mm) in height by vertical suspension in the flame for 12 seconds, the lowest portion of the speciment ¾ inches (19 mm) above the center of the burner. The burner gas mixture is 55±3 percent hydrogen, 24±1 percent methane, 3±1 percent ethane and 18±1 percent carbon monoxide. At the end of 12 seconds, the specimen is withdrawn from the flame slowly, and the after-flame (A-F) and after-glow (A-G) are timed.

After both flaming and glowing have ceased, the char length is measured. The char length is the distance from the end of the specimen, which was exposed to the flame, to the end of a tear (made lengthwise) of the specimen through the center of the charred area as follows: the specimen is folded lengthwise and creased by hand along a line through the highest peak of the charred area. A hook is inserted in the specimen (or a hole, ¼ inch (6 mm) diameter or less, punched out for the hook) at one side of the charred area ¼ inch (6 mm) from the adjacent outside edge and ¼ inch (6 mm) in from the lower end. A weight of sufficient size is attached to the hook. A tearing force is applied gently to the specimen by grasping the corner of the cloth at the opposite edge of the char from the load and raising the specimen and weight clear of the supporting surface. The end of the tear is marked off on the edge and the char length measurement made along the undamaged edge. The specific load applicable to the weight of the test cloth is as follows:

| Specified weight per square yard of cloth before any fire retardant treatment or coating | | Total tearing weight for determining the charred length | |
|---|---|---|---|
| Ounces per Square Yard | g/m² | Pounds | kg |
| 2.0 to 6.0 | 68 to 203 | 0.25 | 0.1 |
| Over 6.0 to 15.0 | Over 203 to 508 | 0.5 | 0.2 |
| Over 15.0 to 23.0 | Over 508 to 780 | 0.75 | 0.3 |
| Over 23.0 | Over 780 | 1.0 | 0.45 |

The results for the samples are reported in Table III. The results illustrate that a reduction in after-glow and after-flame can be accomplished as compared to the undyed standard, namely there is improved flame resistance.

TABLE III

| | | Dye Composition % owf | | | | | FTMS 191-5903 (Unwashed) | | |
|---|---|---|---|---|---|---|---|---|---|
| Run No. | Shade | Basacryl Red GL | Maxilon Blue GRL 300% | Basacryl Yellow X-GFL | Sevron Red 4G | Astrazon Yellow 5GL | Seconds Afterflame | Seconds Afterglow | Inches Char Length |
| 1 | Royal | 0.143 | 1.65 | | | | 0 | 1.6 | 2.7 |
| 2 | Red | | 0.0012 | 1.84 | 2.66 | | 0 | 1.4 | 2.7 |
| 3 | Midnight Navy | 1.55 | 2.6 | 0.79 | | | 0 | 1.3 | 2.6 |
| 4 | Yellow | 0.0157 | | 0.04 | | 0.95 | 0 | 1.1 | 2.7 |
| | Undyed Standard | | | | | | 1.2 | 4.0 | 2.3 |

The dyed fabric of Run 3 (i.e., Midnight Blue shade) is tested for tear strength using Federal Test Method 191-5136 for Trapezoid Tear Strength. Test Method 191-5136 is a measurement of the tearing strength of woven fabrics. A test specimen of cloth, 3 inches by 6 inches is prepared. An isosceles trapezoid having an altitude of 3 inches and bases of 1 inch and 4 inches in length is marked on the specimen. A cut approximately ⅜ inch in length is made in the center of and perpendicular to the 1 inch edge. The specimen is placed in a machine described in Federal Test Method 5100 along the nonparallel sides of the trapezoid so that these sides lie along the lower edge of the upper clamp and the upper length of the lower clamp with the cut halfway between the clamps. The short trapezoid base is held taut and the long trapezoid base lies in the folds. The machine is started and the force necessary to tear the cloth is observed by means of an autographic recording device. The speed of the pulling clamp is 12 inches ±0.5 inches per minute. The tearing strength of the specimen is the average of the three highest peak loads of resistance registered for 3 inches of separation of the tear. Three specimens in each of the warp and filling directions are tested from each sample unit. The tearing strength of the sample unit is the average of the results obtained from the specimens tested in each of the warp and filing directions and is reported separately to the nearest 0.1 pound. The results are reported in Table IV.

TABLE IV

| | Trapezoid Tear | | | |
|---|---|---|---|---|
| | Warp | | Filling | |
| Run | Average | Range | Average | Range |
| 1 | 62.0 | 56–70 | 36.8 | 31–44 |
| 2 | 59.8 | 56–66 | 37.4 | 33–42 |
| 3 | 61.5 | 58–69 | 36.8 | 34–40 |
| Average | 61.1 | 56–70 | 37.0 | 31–44 |
| Scour Only | 55.8 | 51–61 | 36.6 | 34–40 |

The results illustrate that tear strength is maintained and there is no adverse affect thereon when using the carrier of the present invention.

In the specification and examples, there have been disclosed preferred embodiments of the invention. Although specific terms are employed, they are used in a generic and descriptive sense only and not for the purpose of limitation, the scope of the invention being defined by the following claims.

That which is claimed is:

1. A method for dyeing fibrous material which is particularly adapted for use in reducing the adverse effect of dyeing methods on the flame resistant properties of fibrous material having inherent flame resistant properties, the method comprising contacting a fibrous material selected from the group consisting of aromatic polyamide fibers, polybenzimidazole fibers, aromatic polyimide fibers, fibers of copolymers of the monomers thereof, or blends thereof, with an aqueous dyebath comprising a mixture of a dye assistant and a dye soluble or dispersed with the dye assistant in the dyebath, the dye assistant comprising an N-alkyl substituted aromatic sulfonamide.

2. The method according to claim 1, wherein the dye assistant includes an emulsifier.

3. The method according to claim 2, wherein the emulsifier is the reaction product of an alkylene oxide and a straight chain alcohol having $C_{30}$ to $C_{50}$ average chain length.

4. The method according to claim 1, wherein the N-alkyl substituted aromatic sulfonamide is selected from the group consisting of N-(n-butyl)benzenesulfonamide, N-(iso-butyl)benzenesulfonamide, N-(n-propyl)benzenesulfonamide, N-(iso-propyl)benzenesulfonamide, N-(n-butyl)-p-toluenesulfonamide, N-(iso-butyl)-p-toluenesulfonamide, N-(n-propyl)-p-toluenesulfonamide, N-(iso-propyl)-p-toluenesulfonamide, N-(ethyl)-p-toluenesulfonamide, N-(n-butyl)xylenesulfonamide, N-(iso-butyl)xylenesulfonamide, N-(n-propyl)xylenesulfonamide, N-(iso-propyl)xylenesul fonamide, N-(ethyl)xylenesulfonamide, N-(methyl)xylenesulfonamide, N-(n-butyl)cumenesulfonamide, N-(iso-butyl)cumenesulfonamide, N-(n-propyl)cumenesulfonamide, N-(iso-propyl)cumenesulfonamide, N-(ethyl)cumenesulfonamide, N-(methyl)-cumenesulfonamide, N-(ethyl)napthalenesulfonamide, and N-(methyl)-napthalenesulfonamide.

5. The method according to claim 1, wherein the aromatic polyamide is selected from the group consisting of poly(m-phenyleneiso-phthalamide), poly(p-phenyleneterephthalamide), copolymers of the monomers thereof, or blends thereof.

6. The method according to claim 1, wherein the aromatic polyamide is poly(m-phenyleneisophthalamide), and includes 2 to 3 percent by weight carbon fibers encapsulated in an aliphatic polyamide.

7. The method according to claim 1, wherein the step of contacting the fibrous material with the dye assistant and the dye is conducted at a temperature of from about 100° F. to 300° F. and at a pressure of from about 1 to 4 atm.

8. The method according to claim 1, wherein the step of contacting the fibrous material with the dye assistant and the dye is conducted at a temperature of above about 250° F. and at a pressure of above about 2.5 atm, and held at the temperature and pressure for about 15 minutes to about 1.5 hours.

9. The method according to claim 1, wherein the dye is selected from the group consisting of basic, direct, mordant, vat, disperse and reactive dyes, and mixtures thereof.

10. The method according to claim 1, wherein the dyebath includes a flame retardant.

11. A fabric formed from the fibrous material dyed by the method of claim 7.

12. In a method according to claim 1, wherein the aromatic polyamide is a blend of poly(m-phenyleneisophthalamide) and poly(p-phenyleneterephthalamide).

13. The fibrous material according to claim 11, wherein the dye assistant includes an emulsifier.

14. The fibrous material according to claim 13, wherein the emulsifier is the reaction product of an alkylene oxide and a straight chain alcohol having $C_{30}$ to $C_{50}$ average chain length.

15. The fibrous material according to claim 13, wherein the N-alkyl substituted aromatic sulfonamide is selected from the group consisting of N-(n-butyl)benzenesulfonamide, N-(iso-butyl)benzenesulfonamide, N-(n-propyl)benzenesulfonamide, N-(iso-propyl)benzenesulfonamide, N-(n-butyl)-p-toluenesulfonamide, N-(iso-butyl)-p-toluenesufonamide, N-(n-propyl)-p-toluenesulfonamide, N-(iso-propyl)-p-toluenesulfonamide, N-(ethyl)-p-toluenesulfonamide, N-(n-butyl)xylenesulfonamide, N-(iso-butyl)xylenesulfonamide, N-(n-propyl)xylenesulfonamide, N-(iso-propyl)xylenesulfonamide, N-(ethyl)xylenesulfonamide, N-(methyl)xylenesulfonamide, N-(n-butyl)cumenesulfonamide, N-(iso-butyl)cumenesulfonamide, N-(n-propyl)cumenesulfonamide, N-(iso-propyl)cumenesulfonamide, N-(ethyl)cumenesulfonamide, N-(methyl)-cumenesulfonamide, N-(ethyl)napthalenesulfonamide, and N-(methyl)-napthalenesulfonamide.

16. The fibrous material to claim 11, wherein the aromatic polyamide is poly(m-phenyleneisophthalamide) and includes 2 to 3 percent by weight carbon fibers encapsulated in an aliphatic polyamide.

17. The fibrous material according to claim 11, wherein the dye is selected from the group consisting of basic, direct, mordant, vat, disperse and reactive dyes, and mixtures thereof.

18. The fibrous material according to claim 11, wherein the dyebath includes a flame retardant.

* * * * *